US009148737B2

(12) United States Patent
Kroman

(10) Patent No.: US 9,148,737 B2
(45) Date of Patent: Sep. 29, 2015

(54) AUTOMATIC POWER-OFF OF HEARING AID

(71) Applicant: Widex A/S, Lynge (DK)

(72) Inventor: Morten Kroman, Taastrup (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 13/679,265

(22) Filed: Nov. 16, 2012

(65) Prior Publication Data

US 2013/0070946 A1 Mar. 21, 2013

Related U.S. Application Data

(63) Continuation-in-part of application No. PCT/EP2010/057082, filed on May 21, 2010.

(51) Int. Cl.
*H04R 25/00* (2006.01)

(52) U.S. Cl.
CPC ..... *H04R 25/558* (2013.01); *H04R 25/552* (2013.01); *H04R 2225/61* (2013.01); *H04R 2460/03* (2013.01)

(58) Field of Classification Search
CPC ..... H04R 25/00; H04R 25/55; H04R 25/558; H04R 2225/55
USPC ..... 381/312–331
See application file for complete search history.

(56) References Cited

U.S. PATENT DOCUMENTS

| | | | | |
|---|---|---|---|---|
| 4,467,145 | A | 8/1984 | Borstel | |
| 5,202,927 | A | 4/1993 | Topholm | |
| 5,210,803 | A | 5/1993 | Martin et al. | |
| 5,610,988 | A | 3/1997 | Miyahara | |
| 2008/0123882 | A1 | 5/2008 | Bauml et al. | |
| 2009/0052707 | A1 | 2/2009 | Hain | |
| 2009/0087005 | A1* | 4/2009 | Reithinger | 381/317 |
| 2010/0008527 | A1 | 1/2010 | Gottschalk et al. | |
| 2011/0249836 | A1* | 10/2011 | Solum et al. | 381/314 |

FOREIGN PATENT DOCUMENTS

| | | | |
|---|---|---|---|
| CH | 680250 | A5 | 7/1992 |
| DE | 3109049 | A1 | 9/1982 |
| DE | 4034096 | A1 | 1/1992 |
| EP | 1398995 | A2 | 3/2004 |
| EP | 1585367 | A2 | 10/2005 |
| EP | 2028881 | A2 | 2/2009 |
| EP | 2043388 | A2 | 4/2009 |

(Continued)

OTHER PUBLICATIONS

International Search Report with Written Opinion for PCT/EP2010/57082 dated Nov. 8, 2010.

(Continued)

*Primary Examiner* — Matthew Eason

(74) *Attorney, Agent, or Firm* — Sughrue Mion, PLLC

(57) ABSTRACT

A hearing aid system comprises a hearing aid (1) and an external device (2). The external device (2) continuously sends short range power-off commands (4) to the hearing aid (1). Under normal operation of a hearing aid, the range is too short to power-off the hearing. When the hearing aid (1) is placed in close proximity of the external device (2), the hearing aid is within range (3) and will consequently power-off. The method further provides a method of controlling a hearing aid.

21 Claims, 3 Drawing Sheets

(56) References Cited

FOREIGN PATENT DOCUMENTS

| | | | |
|---|---|---|---|
| FR | 2700887 | A3 | 7/1994 |
| JP | 7-79499 | | 3/1995 |
| WO | 2009076949 | A1 | 6/2009 |

OTHER PUBLICATIONS

Office Action for counterpart Singapore Patent Application No. 201207110-6 dated Dec. 18, 2013.

Office Action for counterpart Korean Patent Application No. 10-2012-7030184 dated Jun. 12, 2014.

* cited by examiner

AUTOMATIC POWER-OFF OF HEARING AID

RELATED APPLICATIONS

The present application is a continuation-in-part of application No. PCT/EP2010/057082, filed on May 21, 2010, in Europe and published as WO2011/144259 A1.

BACKGROUND OF THE INVENTION

1. Field of the Invention

The invention relates to the field of hearing aids. The invention, more specifically, relates to hearing aids having an input transducer, a signal processing unit, a power supply unit, and an output transducer. The invention particularly relates to the field of remote controls for hearing aids. The invention further relates to a method of controlling the state of a hearing aid.

Within the context of the present disclosure, a hearing aid should be understood as a small, battery-powered, microelectronic device designed to be worn behind or in the human ear by a hearing-impaired user. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear. The hearing aid serves to alleviate a hearing loss by amplifying sound at frequencies in those parts of the audible frequency range where the user suffers a hearing deficit.

2. The Prior Art

EP-A2-2043388 discloses a hearing aid system of two hearing aids connected with each other through a wireless connection. As the distance between the two hearing aids is constant while in operation at the respective ears of the user, the signal strength of the wireless connection will be constant. If the hearing aids are removed from the users' ears and placed in a box, the signal strength will increase due to the decrease in distance between the two hearing aids. The hearing aids will power-off, when the signal strength reaches a threshold limit.

DE-C2-3109049 discloses a hearing aid with magnetic switches for changing the state of a hearing aid by a magnetic field. Thus, by displacement of a magnet, the state of the hearing aid can be changed.

EP-A2-2028881 discloses two hearing aids capable of communicating with each other through a wireless link and having a mechanism monitoring the signal strength of the magnetic field. If the signal strength increases in only one hearing aid, it can be inferred, that it is a "telephoning" situation, and the program will change accordingly. If the magnetic field increases in both hearing aids, it is inferred that the two hearing aids are in very close proximity of each other and they will power of.

US-A1-20080123882 discloses a hearing aid having means for detecting a change in an acoustic path, whereby it is established that the hearing aid is no longer placed in the ear of the user, accordingly the hearing aid at least partially powers off.

U.S. Pat. No. 5,202,927 provides a remote-controllable, programmable hearing aid system, including a hearing aid with incorporated amplifier and with a signal processing circuit whose transmission characteristic can be determined at any time by a set of control parameters, and an external control unit with a transmitter for wireless transmission of control parameters to the hearing aid. A receiving circuit for receiving the control parameters is located in the hearing aid.

WO-A1-2009076949 provides a hearing aid having means for entering or leaving a stand-by mode initiated by a remote control. During use, a dedicated stand-by command issued by the remote control is received and decoded in the hearing aid.

Many hearing aids today can be controlled by a remote control, which gives the user of the hearing aid an easier way to control the hearing aid. In some cases the user might also be able to power-off the hearing aid or change the state to a stand-by mode using the remote control, where the hearing aid turns off most processing, keeping power on at just a minimum of circuits sufficient to power up the hearing aid from the stand-by mode using the remote control.

For a lot of elderly people with a hearing loss the handling of hearing aids can be difficult, because they are small, so that it is not easy to manipulate control buttons or to visually recognize whether the hearing aids are turned on or off. Consequently a lot of elderly people do not turn off their hearing aids when they are not in use, which drains the batteries quickly and decreases the life time of the batteries.

SUMMARY OF THE INVENTION

It is a feature of the present invention to provide a simple and easy way to power-off and power-on a hearing aid.

The invention, in a first aspect, provides a hearing aid comprising a power supply, a microphone, a receiver, a signal processor and an RF receiver for receiving commands wirelessly from an external device, said processor being adapted for at least a first and a second mode of operation, where the first mode is a stand-by mode and the second mode is an operational mode, wherein the processor is adapted to respond to a message received by the RF receiver by switching from the second mode into the first mode, and wherein the processor is adapted to respond to the absence of the message for a predetermined interval of time by switching from the first mode to the second mode.

By having a remote control sending a constant power-off command with a very short range, the hearing aid will power-off when the hearing aid and the remote control are in close proximity of each other, for instance when they are stored together in their storage box, in a pocket, at the night stand, or elsewhere. Once the hearing aids are moved out of the short range, e.g. by being placed at the respective ears of the user, while the remote control is placed in the pocket, the power-off command is no longer detected by the hearing aids, which then default to powering up.

With the present invention, the user does not have to actively push a button on the hearing aid remote control or other external device associated with the hearing aid to power-off the hearing aid. The remote control or other associated device is constantly sending power-off commands to the hearing aid, however these commands are sent with such a low power, that the hearing aid will not detect the commands until the hearing aid is within a relatively short range of the external device, which might be around 10 cm or less. Once the hearing aid no longer detects the power-off command, the hearing aid automatically comes to life again and is fully operable.

It will be understood that although it is common to refer to a state of power-off, within the field of soft power switching artisans may find it more correct to refer to a sleep-mode, as some circuits are still powered, in order that the device is capable of responding to a command by waking up. Thus the device really has three states, normal operation, sleep mode, and completely un-powered mode. Un-powered mode will not be discussed further here, and within the context of the present disclosure, the term power-off mode will be used to designate the sleep mode, unless specifically indicated to the contrary.

The invention, in a second aspect, provides a hearing aid accessory device, comprising remote control transmission means for sending commands to a hearing aid to switch at least one operational setting of said hearing aid, said remote control transmission means being adapted for continuously transmitting commands to said hearing aid for instructing the hearing aid to switch the operational mode, said commands being transmitted at a low level of power so as to limit the effective range of the commands.

The invention, in a third aspect, provides a method to control the operational mode of a hearing aid by an external remote control device, comprising adapting the hearing aid to respond to a message received by the hearing aid by switching from an operational mode into a stand-by mode, and to respond to the absence of the message for a predetermined interval of time by switching from the stand-by mode into the mode of normal operation.

Further features and advantages will appear from the dependent claims.

BRIEF DESCRIPTION OF THE DRAWINGS

The invention will now be described in further detail with reference to the drawings, where.

DETAILED DESCRIPTION OF THE INVENTION

Figure 1:
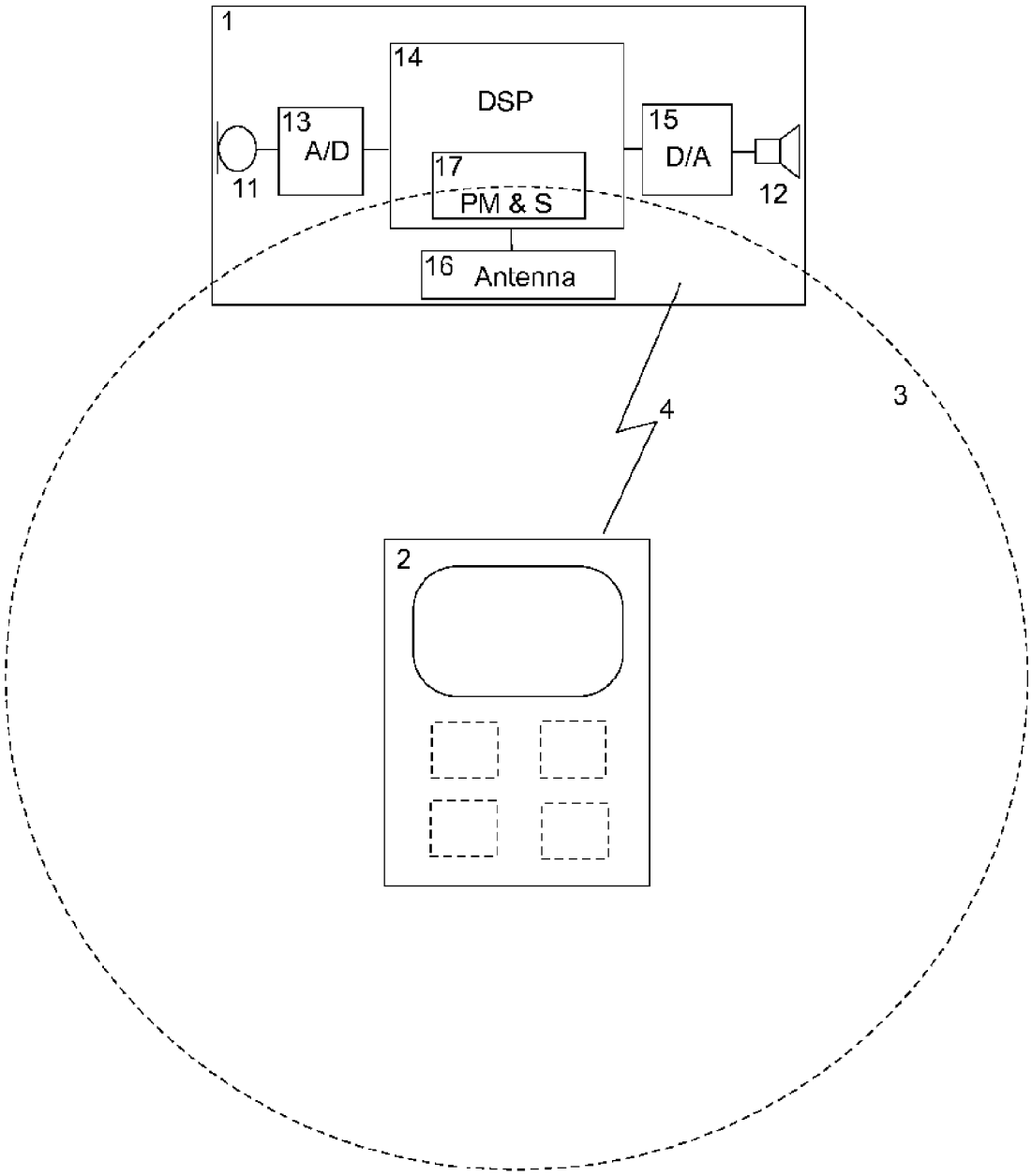
FIG. 1 is a hearing aid with a remote control within the range of the power-off command.

FIG. 1 shows the system according to an embodiment of the invention. A hearing aid 1 has a microphone 11, an analog to digital converter (A/D) 13, a digital signal processor (DSP) 14, a digital to analog converter (D/A) 15, a loudspeaker 12, an RF receiver 16, and a power management and scheduler block (PM & S) 17. In one embodiment, the hearing aid has also an RF transmitter (not shown).

A remote control 2 has user interface comprising a display and buttons. The remote control has an RF transmitter and an RF receiver for communication at 4 with the hearing aid. The remote control serves to receive user inputs and to respond by sending suitable program commands to the hearing aid, e.g. for adjusting the volume or changing program. Thus when the user presses a button on the remote control, e.g. a request to turn up the volume, a command is sent with a power giving the command an effective reach of about 100 to 150 cm.

The RF transmitter, however, is adapted for operating in two modes, a low power mode and a high power mode. High power mode is used for normal user commands, in order that the user can hold the device in his or her hand and broadcast commands that will likely be picked up by both hearing aids.

The low power mode has an effective range of only approximately 10 cm from the remote control. The low power capability enables the remote control to continuously send power-off commands 4, limiting the range of the signal to be picked up by the hearing aids to a predetermined distance 3. Beyond this distance, e.g. while the hearing aids are positioned in the respective ears of the user, and as long as the remote control is not held close to one of the ears, the commands will not be picked up by the hearing aids.

Figure 2:
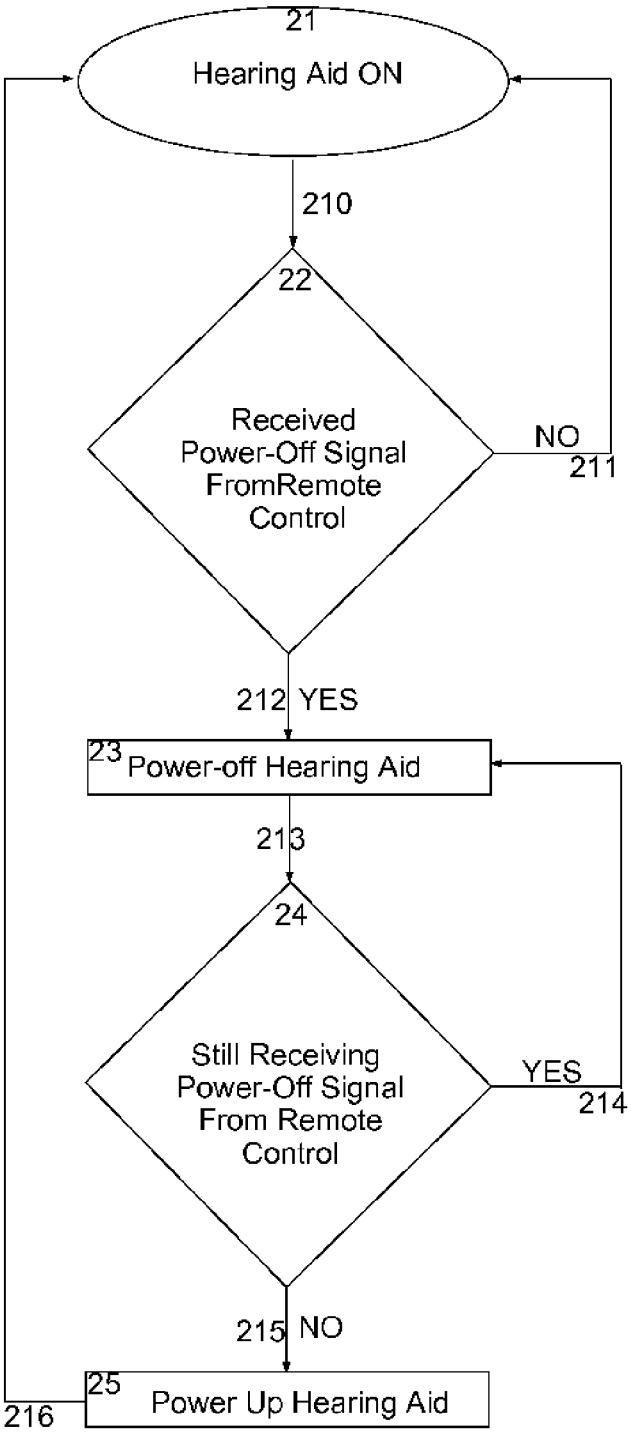
FIG. 2 is a block diagram of the decision logic in the power management system of a hearing aid according to the invention.

FIG. 2 shows a flow diagram of the power management system in a hearing aid according to an embodiment of the invention. When the hearing aid is "on" 21, it is constantly monitoring 210 whether a power-off command is detected on the RF receiver 22. As long as no power-off command is detected, e.g. because that the external device sending the power-off command is out of the short range of the hearing aid, command loops by 211, and the hearing aid stays "on" 21. If a power-off command is detected, the hearing aid is within the short range of the device sending the power-off command, and control branches by 212 where the hearing aid powers down, 23.

Figure 3:
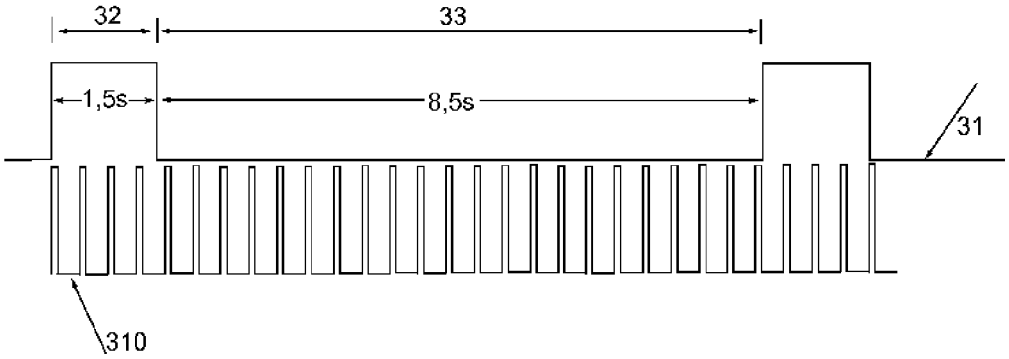
FIG. 3 is a timing diagram of the hearing aid power management cycles and the power-off bursts from the remote control.

When the hearing aid powers down, it enters a stand-by mode, where the scheduler and the power management systems are still active, the scheduler having an on/off cycle as shown in FIG. 3. The scheduler orders the power management system to enable the RF receiver circuit to check whether the power-off command is still detectable 24 (FIG. 2). If this is the case, the hearing aid is still within the short range of the external device sending the power-off command 214, and the power management system branches by 214 to deactivate the RF receiver again and set the hearing aid back into stand-by mode 23. If no power-off command is received, the hearing aid is beyond the short range from the device sending the power-off command, and the power management system branches by 215 to power-up the hearing aid 25, whereby the hearing aid will return, 216, to normal operation 21.

FIG. 3 shows a timing diagram of the cycles for the hearing aid RF receiver 31 and the off-bursts 310 of the remote control. The scheduler activates the power management and the RF receiver for an awake interval 32 of 1.5 seconds, where after the scheduler orders the power management system to deactivate the RF receiver for sleep interval 33 of 8.5 seconds, which again is followed by another cycle of awake interval of 1.5 seconds and off-interval 33 of 8.5 seconds. As the remote control continuously sends power-off commands three times per second and each of one millisecond duration, 310, the hearing aid RF receiver will detect at least 3 bursts of off commands during the awake interval 32 while the RF receiver is open for communication.

When the hearing aid 1 is in its normal active state, it is monitoring the commands received via the RF receiver 16, from the remote control 2 or any other external device associated with the hearing aid 1. A hearing aid usually receives commands through an RF receiver in the hearing aid. In a normal operating mode of the hearing aid, the hearing aid will switch to a state or a program according to the command received from the remote control.

According to the invention, the hearing aid will switch to power-off or stand-by mode, when a power-off command is detected. While in stand-by, parts of the hearing aid will wake up from the stand-by mode at frequent intervals. The interval could preprogrammed or set during the fitting of the hearing aids. The frequency of the intervals whereby the hearing aid wakes up is preferably in the range of the time it will take a user to pick up the hearing aids from the storage box and place them at or in the ears. It takes a few seconds for the hearing aid to power up from stand-by to fully operational mode, and often it is not desired to have the hearing aids in operational mode before they are placed at the ears of the user, as the hearing aid may need some time to reach a normal steady state mode of operation, e.g. for measuring the feedback path and adapting the processor to cancel any undesired feedback signals.

Another issue, when deciding the interval whereby the hearing aid should wake up, is the self-discharge of the hearing aid battery, which depends on the type of battery used for that particular type of hearing aid. If the frequency of the scheduled wake-ups is too high, it will drain too much power from the battery. On the other hand, if the frequency is too low, it will be annoying for the user, as the user will have to wait for the hearing aid to be fully operational. By selecting an appropriate wake-up interval in between the two extremes, the system can be designed to use no more power than the self-discharge of the battery would be, if the hearing aid was completely powered off, i.e. the system is cost free in terms of battery life time. The frequency whereby the hearing aid wakes-up from the stand-by mode is handled by a scheduler, 17. The scheduler 17 is always active, also when the hearing aid is in stand-by mode. The scheduler activates a power management system that handles powering-up the necessary parts of the hearing aid, which is in this case the RF receiver system.

The frequency of the power-off command sent from the external device 2 to the hearing aid 1 should be at least the same and preferably higher, than the frequency whereby the scheduler of the hearing aid enables the RF receiver. While the hearing aid 1 is powered down, a part of the signal processor containing the scheduler and the power management 17 is still active. When the scheduler determines that it is time to check whether a power-off command is detectable, the power management system will power up the RF receiver to verify the detection, or absence, of the power-off command. If the predetermined time interval expires without any power-off command having been detected, the power management circuit will power-up the rest of the hearing aid. If there is still a detectable power-off command, the power management circuit will put everything but the power management circuit and the scheduler back to stand-by mode.

One embodiment is adapted to handle the wake-up intervals of the power management system of the hearing aid and the power-off commands from the remote control by running the power management system in cycles of 10 seconds, where the RF receiver is on for an interval of 1.5 seconds followed by an interval of 8.5 seconds where it is off. The remote control is sending short range bursts of power-off commands of inns duration with 3 bursts per second. If the RF receiver has not detected a power-off command within the 1.5 seconds where it is on, the power management system will power-up the hearing aid.

In remote controls for hearing aids, there is a transmitter which connects with the RF receiver in the hearing aid to create a coupling magnetic field between the two devices. The system according to an embodiment of the invention may work in a magnetic coupling system or any other kind of RF receiver system.

The remote control or other external device is continuously sending a power-off command with low signal strength, which will not be detectable for the hearing aid at distances beyond approximately 10 cm. When an ordinary command is sent from the remote control, this could be a command for the hearing aid to switch program or turn the volume up or down, the push on the button will make a power amplifier boost the signal being sent to the hearing aid, enabling the command to be detected by the hearing aid at a much longer distance.

While the hearing aid RF receiver is on, the current drain is approximately 250 μA. When the RF receiver is on for a duty cycle of 1.5 seconds out of a 10 second interval, the current drain for the RF receiver is around 37.5 μA in average. The self discharge of a zinc-air battery, as often used in hearing aids, is around 50 μA. Thus the system is virtually cost free in terms of power consumption in relation to the self discharge of the battery.

An ordinary hearing aid battery has a capacity of around 90 mAh. The power consumption of the hearing during normal operation is typically about 1 mA, meaning that the battery will power it for some 90 hours of normal operation. With the hearing aid in the power off mode, listening for the power off signals as explained with the current drain of around 37.5 μA, the battery powering only the automatic wake-up system, the battery could last for 2400 hours or 100 days.

The remote control will normally accommodate a larger battery whereby the power consumption is less critical. Yet, the current drain for sending a short range signal in bursts of 1 ms in cycles of 3 bursts per second is around 0.9 μA. A normal range command i.e. volume up/down, change program etc, draws around 7 μA on average. This implies that the current drain of the short range power-off command will have only negligible effect on the lifetime of the battery.

In one embodiment of the invention, the hearing aid has to detect a number of power-off commands within a specified time frame, before it actually executes the order to shut down parts of the electronics. This avoids that the user accidently powers down the hearing aid, because the remote control for a short period of time gets near the hearing aid.

One embodiment requires that the RF receiver has detected at least two power-off commands, before going into stand-by mode. A modified embodiment requires that a power-off command is detected at the end of the RF receivers active period, e.g. within the last ⅓ of a second or the last ½ a second.

In an embodiment of the invention, the hearing aid sends a verification message back to the external device, when it changes state from being "on" to being in stand-by mode, and again when it powers back on to normal operation. Provided the remote control has a suitable RF receiver and user interface, the user will be able to see that the hearing aid is either in normal operation or in stand-by. The hearing aid may also warn the user of the hearing aid that it is now entering stand-by mode, which may be useful in case the user has unintentionally moved the external device into the power-off range of the hearing aid, so as to provide him or her with a warning in time to allow for corrective action.

In another embodiment of the invention, the hearing aid has means for visually indicating the state of the hearing aid. This could be used to confirm to the user whether the hearing aid is off or on, when it is located in the storage box or at the night stand. This visual indicator could be a light emitting diode, a MEMS display or an interferomatic modulator display, where especially the last two have the advantage of using close to zero power and thereby incurring minimal battery power drain.

I claim:

1. A hearing aid system comprising a hearing aid and a remote control device, the hearing aid having a power supply, a microphone, a receiver, a signal processor and an RF receiver for receiving commands wirelessly from an external device, said processor being adapted for at least a first and a second mode of operation, where the first mode is a stand-by mode and the second mode is an operational mode, wherein the processor is adapted to respond to a message from the remote control received by the RF receiver by switching from the second mode into the first mode, and wherein the processor is adapted to respond to the absence of the message for a predetermined interval of time by switching from the first mode to the second mode; and wherein the remote control device has an RF transmitter adapted for continuously transmitting power-off commands in a low power mode so as to limit the effective range of the power-off commands.

2. A hearing aid system comprising a hearing aid and a remote control device, the hearing aid having a power supply, a microphone, a receiver, a signal processor and an RF receiver for receiving commands wirelessly from said remote control device, said processor being adapted for at least a first and a second mode of operation, where the first mode is a stand-by mode and the second mode is an operational mode, wherein the processor is adapted to respond to a power-off command from the remote control received by the RF receiver by switching from the second mode into the first mode, and wherein the processor is adapted to respond to the absence of the power-off command for a predetermined interval of time by switching from the first mode to the second mode; and wherein the remote control device has an RF transmitter adapted for continuously transmitting power-off commands in a low power mode so as to limit the effective range of the power-off commands.

3. The hearing aid system according to claim 2, comprising a scheduler for activating the RF receiver for a first interval of time and deactivating the RF receiver for a second interval of time.

4. The hearing aid system according to claim 3, where said scheduler has a predetermined activation and deactivation cycle.

5. The hearing aid system according to claim 3, where the first interval of time is shorter than the second interval of time.

6. The hearing aid system according to claim 2, wherein the processor comprises a power management system for controlling the switching from the first mode to the second mode, and from the second mode to the first mode.

7. The hearing aid system according to claim 2, comprising an RF transmitter for transmitting an acknowledgement message to the remote control device, when shifting from one mode to the other.

8. The hearing aid system according to claim 7, comprising means for visually indicating the mode of the hearing aid.

9. A hearing aid accessory device, comprising remote control transmission means adapted for continuously transmitting commands to a hearing aid for instructing the hearing aid to switch to a first mode, said commands being transmitted at a low level of power so as to limit the effective range of the commands, said remote control transmission means being further configured to transmit longer range commands at higher power on request.

10. The device according to claim 9, adapted for sending short range commands at, at least the same frequency as the hearing aid activation cycle.

11. The device according to claim 9, having a power boost circuit to enable longer range commands to be sent from said device to the hearing aid on request, said power boost circuit being enabled in response to user request for transmission of a said longer range command.

12. The device according to claim 9, having means to receive and display status indications from the hearing aid.

13. The device according to claim 9, comprising a storage box.

14. The device according to claim 9, wherein said longer range commands include program commands to the hearing aid at a level of power sufficient to reach two hearing aids in a normal use position.

15. A method to control the operational mode of a hearing aid by an external remote control device, comprising adapting the hearing aid to (i) respond to a stand-by commands received by the hearing aid by switching from an operational mode into a stand-by mode, (ii) to respond to the absence of the stand-by commands for a predetermined interval of time by switching from the stand-by mode into the mode of normal operation, and (iii) respond to programming commands transmitted to said hearing aid from said remote control device at a higher transmission power level than said stand-by commands.

16. (The method according to claim 15, comprising continually sending a short range stand-by command from said external device to said hearing aid.

17. The method according to claim 16, comprising enabling the switching of mode in the hearing aid from standby-mode to operational mode for a predetermined cyclic timeframe as programmed into the hearing aid.

18. The method according to claim 17, where the frequency of commands sent from the external device is at least the reciprocal of the time frame, where the shift in mode is possible.

19. The method according to claim 15, comprising using power amplifier means in the external device to boost the range of the commands sent to the hearing aid on request, said power amplifier means being enabled in response to user request for transmission of a command which is desired to have longer range.

20. The method according to claim 17, comprising visually indicating at the hearing aid or the external device the operational mode of the hearing aid.

21. The hearing aid according to claim 1, wherein said message is a power-off command continuously sent by said external device at a low power so as to limit the effective range of the power-off command.

* * * * *